US011601746B2

(12) United States Patent
Schreuder

(10) Patent No.: US 11,601,746 B2
(45) Date of Patent: Mar. 7, 2023

(54) INTEGRATED SUB-ASSEMBLY FOR WEARABLE AUDIO DEVICE

(71) Applicant: Dopple IP B.V., Emmen (NL)

(72) Inventor: Johannes Lucas Schreuder, Ees (NL)

(73) Assignee: DOPPLE IP B.V., Emmen (NL)

( * ) Notice: Subject to any disclaimer, the term of this patent is extended or adjusted under 35 U.S.C. 154(b) by 33 days.

(21) Appl. No.: 17/265,851

(22) PCT Filed: Aug. 5, 2019

(86) PCT No.: PCT/EP2019/070993
§ 371 (c)(1),
(2) Date: Feb. 4, 2021

(87) PCT Pub. No.: WO2020/030576
PCT Pub. Date: Feb. 13, 2020

(65) Prior Publication Data

US 2021/0176557 A1 Jun. 10, 2021

Related U.S. Application Data

(60) Provisional application No. 62/714,788, filed on Aug. 6, 2018.

(51) Int. Cl.
*H04R 25/00* (2006.01)
*H04R 1/10* (2006.01)
*H01Q 1/24* (2006.01)

(52) U.S. Cl.
CPC ..... *H04R 1/1075* (2013.01); *H01Q 1/24* (2013.01); *H04R 1/1066* (2013.01)

(58) Field of Classification Search
CPC .... H04R 25/554; H04R 25/558; H04R 25/60; H04R 25/609; H04R 2225/51; H04R 2225/57; H04R 2420/07; H04R 25/602
See application file for complete search history.

(56) References Cited

U.S. PATENT DOCUMENTS 9,419,846 B2 8/2016 Miller et al.
9,425,502 B2 8/2016 Chen et al.
(Continued)

FOREIGN PATENT DOCUMENTS

EP 2640170 A1 9/2013

*Primary Examiner* — Amir H Etesam
(74) *Attorney, Agent, or Firm* — Coats & Bennett, PLLC

(57) ABSTRACT

An audio headset sub-assembly (600, 700, 900, 1000, 1200, 1300, 1500) providing the operative functionality for true wireless headphones/headset (100) includes circuitry operative to effect wireless communication and audio signal processing, and a battery (212). These circuits and battery (212) are contained in a sealed enclosure (610, 710, 1210, 1310). In one embodiment, the sub-assembly (600, 700, 900, 1000, 1200, 1300, 1500) includes all electronic components for wireless communications and audio signal processing, and a battery (212), but does not include a speaker. A microphone (240) may be part of the sub-assembly (600, 700, 900, 1000, 1200, 1300, 1500) or may be external. In another embodiment, a speaker (230) is part of the sub-assembly (600, 700, 900, 1000, 1200, 1300, 1500) as well. The sub-assembly (600, 700, 900, 1000, 1200, 1300, 1500) may include several cavities (1254, 1252) and vents (1264, 1262) before and behind the speaker (230) for optimal acoustic performance. The sub-assembly (600, 700, 900, 1000, 1200, 1300, 1500), and any necessary external audio components, can be inserted in an external housing (104) forming the visual product appearance and the anthropometric comfort and fit design of a true wireless headphone or headset (100).

25 Claims, 16 Drawing Sheets

(56) References Cited

U.S. PATENT DOCUMENTS

| | | | | |
|---|---|---|---|---|
| D802,760 | S | 11/2017 | Neby | |
| 2007/0229369 | A1* | 10/2007 | Platz | H04R 25/554 343/866 |
| 2011/0299713 | A1* | 12/2011 | Moller | H04R 25/65 381/328 |
| 2014/0323183 | A1 | 10/2014 | Klein | |
| 2015/0207216 | A1 | 7/2015 | Fujita et al. | |
| 2016/0295336 | A1* | 10/2016 | Moller | H04R 25/65 |
| 2018/0070179 | A1 | 3/2018 | McAuliffe et al. | |

* cited by examiner

INTEGRATED SUB-ASSEMBLY FOR WEARABLE AUDIO DEVICE

RELATED APPLICATIONS

This application claims the benefit of U.S. Provisional Patent Application No. 62/714,788, filed Aug. 6, 2018, which is hereby incorporated by reference in its entirety.

FIELD OF INVENTION

The present invention relates generally to electronics devices, such as electronics devices for voice communications and music listening. More particularly, the invention relates to a sub-assembly for wireless audio devices wearable on the body.

BACKGROUND

The use of audio devices, such as headsets and headphones, wirelessly connected to host devices like smartphones, laptops, and tablets, is becoming increasingly popular. Whereas consumers used to be tethered to their electronic devices with wired headsets, wireless headsets are gaining more traction due to the improved user experience, providing the user more freedom of movement and ease of use. Wireless audio devices allow the user to enjoy untethered music entertainment and voice communications. Further momentum for wireless headsets has been gained by certain smartphone manufacturers abandoning the implementation of the 3.5 mm audio jack in the smartphone for wired connections, and promoting voice communications and music listening wirelessly, for example by using Bluetooth® technology.

Headsets and headphones come in many forms and features. Over-the-ear headsets allow immersive listening to high quality sound. In-ear headsets (ear buds placed in the ear canal or in the concha) are more flexible and provide less presence to the user. Most of these in-ear headsets and headphones consist of a left and right ear bud connected with a cable or neckband. More recent designs offer a separate left and right ear bud with no connection between the buds. Examples of these so-called True Wireless headsets are the Apple AirPods and the Samsung IconX.

For ease of use and wearing comfort, miniaturization is key for in-ear headsets. Yet product miniaturization faces many challenges in robustness and reproducible manufacturing. For very small device, the placement of components becomes very important for the wireless performance since the antenna effectiveness is impacted by its surroundings. Small variations in separation between the antenna and conductive elements in the surroundings may give rise to large variations in the RF performance of the radio. Variations not only occur in the design process but also in the manufacturing process, especially if the volumes of these products exceed millions per month. A good user experience for all of these users becomes more and more important.

Furthermore, the performance of these small headsets is plagued by environmental substances like (salty) water, sweat, dust, body lotion, sunburn oil, and so on. These substances may affect the proper operation of the electronics inside the audio device and may erode conductive lines and contacts, for example at the battery, with the danger of short-circuiting. Coating (e.g., parylene or nano coatings) complicates the manufacturing process and does not always give sufficient protection. In addition, new regulations regarding safety (see for example IEC 62368-1, Safety requirements for audio/video, information and communication technology equipment, 2014) requires product designers to build in safeguards against malfunctioning components like the battery, in order to prevent fire, injury, or other harmful effects when using the product.

For each new product design, the developers face these challenges again and again. Conflicting requirements between the electronic designers (dealing with performance and safety), visual designers (dealing with look and feel, ergonomics like user interface, comfort, and fit, and dealing with color/material/finish, or CMF), and manufacturing (dealing with yield, reproducibility, tolerances), frequently delay the product launch, affect the time-to-market, and eventually the success of the product on the market.

It is therefore the intention of the inventors to introduce a new method and concept that allows product designers to make use of pre-fabricated, miniaturized, sealed sub-assemblies that have predictable performance and are highly reproducible.

The Background section of this document is provided to place embodiments of the present invention in technological and operational context to assist those of skill in the art in understanding their scope and utility. Unless explicitly identified as such, no statement herein is admitted being prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the invention or to delineate the scope of the invention. The sole purpose of this summary is to present some concepts disclosed herein in a simplified form as a prelude to the more detailed description that is presented later.

According to one or more embodiments described and claimed herein, a sub-assembly includes circuitry and a battery operative to effect wireless communication and audio signal processing. These circuits and battery are contained in a sealed enclosure. The sub-assembly provides the fundamental functionality for true wireless headphones/headset, and may be designed into a variety of wireless audio devices, having varying degrees of functionality and sophistication.

In one embodiment, the sub-assembly includes all electronic components for wireless communications and audio signal processing, and a battery. A speaker is not part of the sub-assembly. A microphone may be part of the sub-assembly or may be external. The audio components are connected to the sub-assembly via a connector to provide a fully functional wireless audio device. Audio components and the sub-assembly can subsequently be inserted in an external housing forming the visual product appearance and the anthropometric comfort and fit design.

In another embodiment, a speaker is part of the sub-assembly as well. The sub-assembly includes several cavities and vents before and behind the speaker for optimal acoustic performance. This self-contained sub-assembly can be inserted in an external housing forming the visual product appearance and the anthropometric comfort and fit design.

One embodiment relates to an audio headset sub-assembly comprising a battery and a folded electronics construction, including flexible parts and folded around the battery, placed together in a contained enclosure, the folded electronics construction holding components implementing functionality including: an antenna; a radio transceiver; a microcontroller; an audio codec; a power management unit; and a connector coupled to the board. The contained enclosure is characterized by a first cavity including the battery and the folded board, the cavity being completely sealed to repel environmental substances; air space to allow for the battery to swell in the event of malfunction; and a hole in the enclosure wherein the connector is sealed.

Another embodiment relates to a method of manufacturing an audio headset sub-assembly. An electronics construction is provided. The electronics construction comprises an antenna formed on a first side of a first rigid PCB, a microcontroller mounted on a first side of a second rigid PCB, and a first flexible PCB connecting the first and second rigid PCBs such that the first sides of rigid PCBs face the same direction when all circuit boards are coplanar. The electronics construction is folded by bending the first flexible PCB such that the first rigid PCB overlays and is spaced apart from the second rigid PCB, wherein the first sides of the first and second rigid PCBs face away from each other. The folded electronics construction and a battery are encapsulated in an enclosure that is completely sealed to repel environmental substances.

BRIEF DESCRIPTION OF THE DRAWINGS

The present invention will now be described more fully hereinafter with reference to the accompanying drawings, showing several embodiments of the invention. However, this invention should not be construed as limited to the embodiments set forth herein. Rather, these embodiments are provided so that this disclosure will be thorough and complete, and will fully convey the scope of the invention to those skilled in the art. Like numbers refer to like elements throughout.

FIG. 1(*b*) shows an intended use of the wireless audio device of FIG. 1 with a smartphone.

DETAILED DESCRIPTION

For simplicity and illustrative purposes, the present invention is described by referring mainly to exemplary embodiments thereof. In the following description, numerous specific details are set forth in order to provide a thorough understanding of the present invention. However, it will be readily apparent to one of ordinary skill in the art that the present invention may be practiced without limitation to these specific details. In this description, well known methods and structures have not been described in detail so as not to unnecessarily obscure the present invention.

Figure 1B:
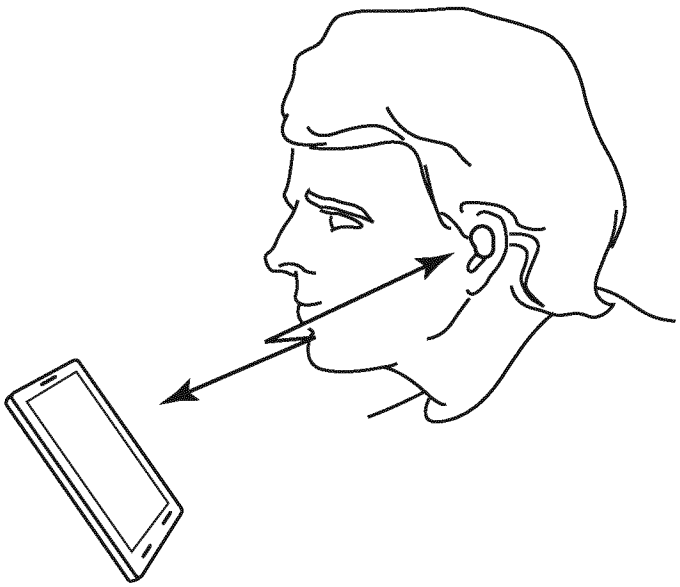
FIG. 1(*a*) shows a cross section of an exemplary wireless audio device.
Figure 1A:
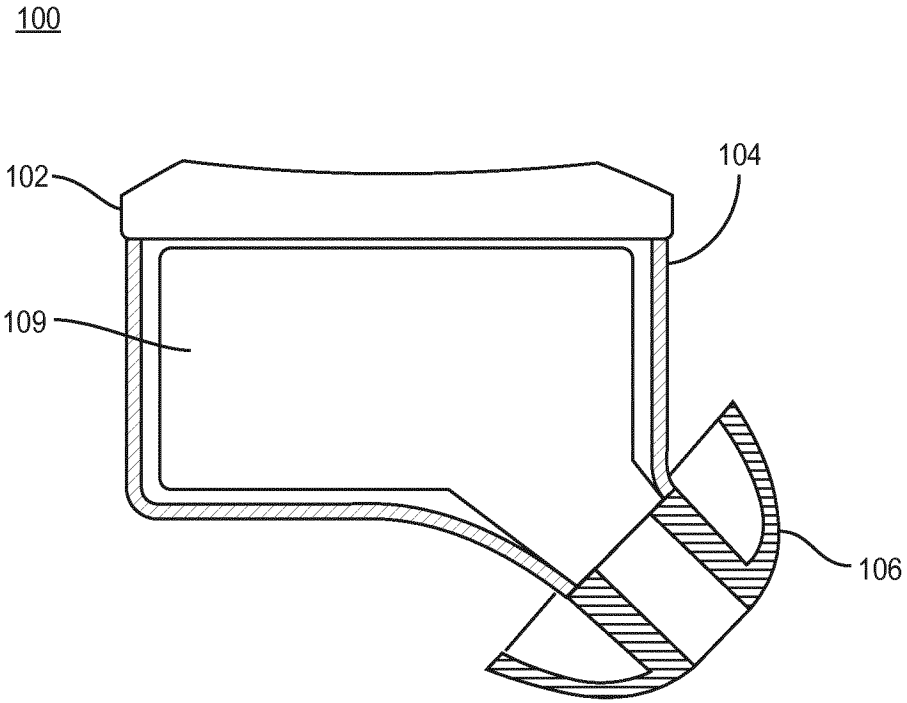

The inventors have recognized that for stable design and manufacturing process with predictable outcome, for miniaturized product design it is advantageous to split the product into an interior 109 as shown in FIG. 1(*a*), containing all the functional components such as the battery, speaker, MIC, radio, and other electronics, and an exterior. The exterior may consist of several elements like a housing 104, a top cap 102, and an ear tip 106. The exterior determines the visual design and the ergonomics like the fit, wearing comfort, and the user interface (UI). According to embodiments of the present invention, the interior is designed as a sub-assembly with predictable performance. This allows product designers to make a variety of products with their own visual design and branding, characteristic for the brand appearance. FIG. 1(*b*) shows one use case, with a wireless audio connection between a smartphone and the wireless audio device of FIG. 1(*a*), positioned within a user's ear.

Figure 2:
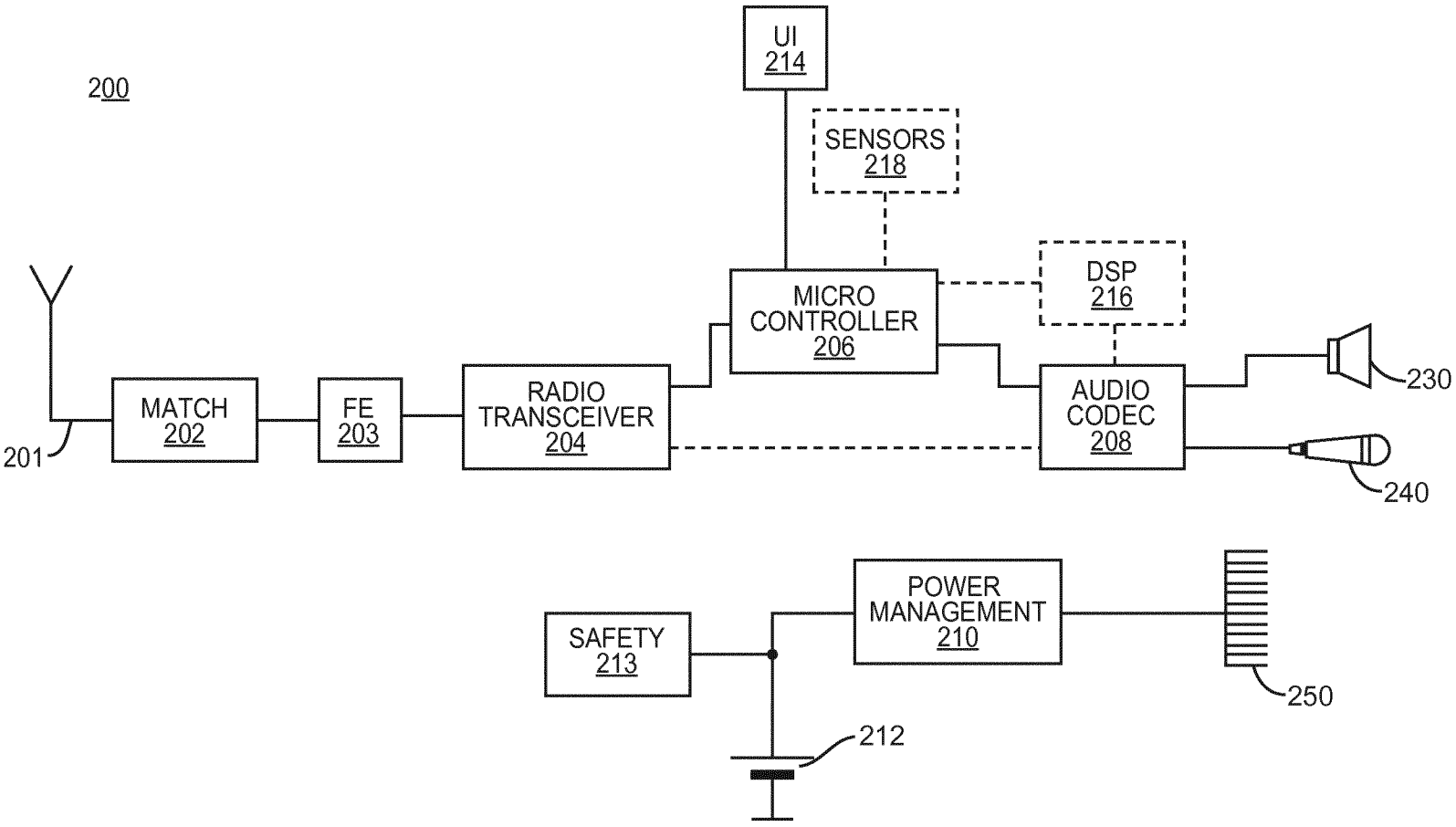
FIG. 2 is a schematic block diagram of an exemplary wireless audio system according to aspects of the invention.

A high-level functional schematic diagram of the electrical and acoustical components inside the interior 109 is shown in FIG. 2. Antenna 201 is dimensioned to receive and transmit radio signals at carrier frequencies in the GHz range. For a wireless system like Bluetooth®, the carrier frequencies are found in the 2.4 GHz ISM band ranging from 2400 MHz to 2483.5 MHz. Matching circuitry 202 provides the proper impedance levels for the signals to enter the RF front-end circuit FE 203. The FE 203 typically consists of a low-noise-amplifier (LNA, not shown) to increase the level of the incoming signal, a power amplifier (PA, not shown), and possibly some RF switches (not shown) to guide the incoming and outgoing signals. Radio transceiver 204 converts the RF signals into digital messages (including frequency down-conversion, decoding, decrypting, and de-packetizing).

The digital messages are then transferred to a microcontroller 206 for further processing. Signals may then be processed in an audio codec 208 where they are converted to the analog domain. The analog signal can then drive a speaker 230, so that the user can experience music or voice communications. In the opposite direction, a microphone 240 may be present to pick-up the voice of the user. This voice signal is then digitized in audio codec 208 and via the microcontroller 206. The radio transceiver 204 then places it on a 2.4 GHz radio carrier to be transmitted by antenna 201.

For more advanced audio processing (multi-MIC beam forming, active noise cancellation, etcetera), a Digital Signal Processor (DSP) 216 may be added.

The electronic circuitry must be powered by a stable power source. Rechargeable battery 212 provides energy to the entire system. Safety circuitry 213 monitors the battery for malfunctioning, and can shut off the power supply if necessary. Power management unit (PMU) 210 conditions power from the battery to provide stable, interference-free voltages and currents to the various electronic components. PMU 210 also serves as a charge controller when the battery is (re-)charged via an external energy source that is entered via connector 250. For the user to operate the product, a user interface (UI) 214 is present (e.g., buttons, touch, or other controls), which signals are fed into the microcontroller 206. Sensors 218 may be added to provide more features to the product. Functional components in diagram 200 have been shown as separate entities. However, it will be readily apparent to one of ordinary skill in the art that certain functional components may be integrated onto the same silicon chip (integrated circuit, or IC). For example, radio transceiver 204 and microcontroller 206 can be part of the same IC. In some embodiments, audio codec 208 and/or PMU 210 can also be part of this IC.

To provide connectivity, the components are placed on a carrier or board that includes conductive lines connecting the different components. This board can be a rigid Printed Circuit Board (PCB) with several layers, i.e., alternatively isolating and (patterned) conductive layers. Advanced PCBs may also be flexible, and can also be multi-layered. It is also possible to make a combination of flexible and rigid PCBs, so-called flex-rigid PCBs. Using (partly) flexible PCBs allows for further miniaturization because of the freedom to fold and wrap the board in the proper product size.

Figure 3:
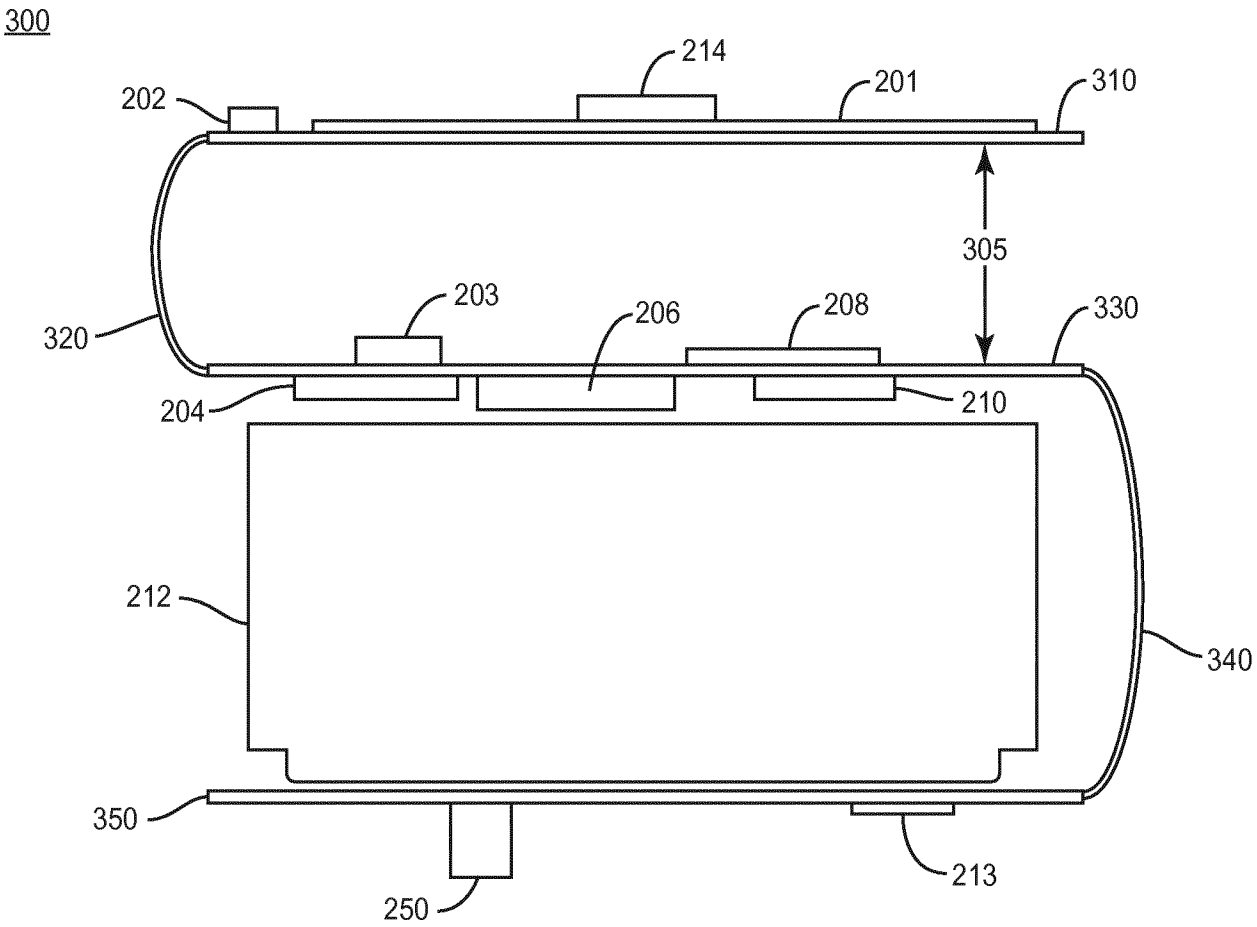
FIG. 3 is a side view of a folded electronics construction implementing the electronics of FIG. 2 according to one embodiment.
Figure 4:
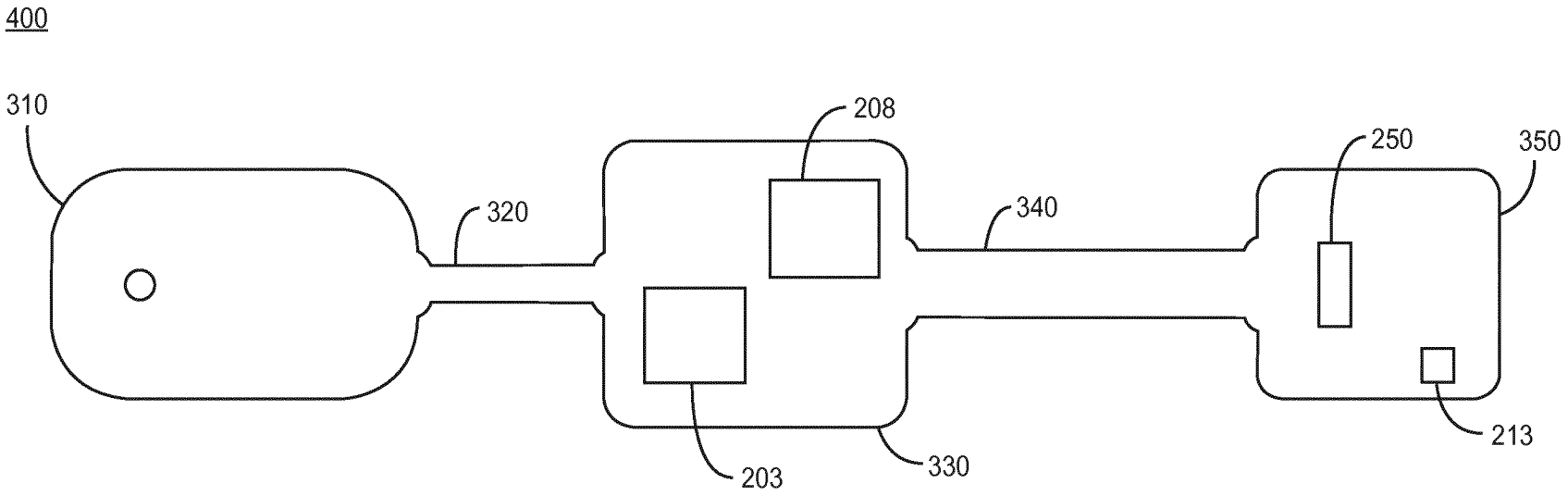
FIG. 4 is the top view of the PCBs as shown in FIG. 3.
Figure 5:
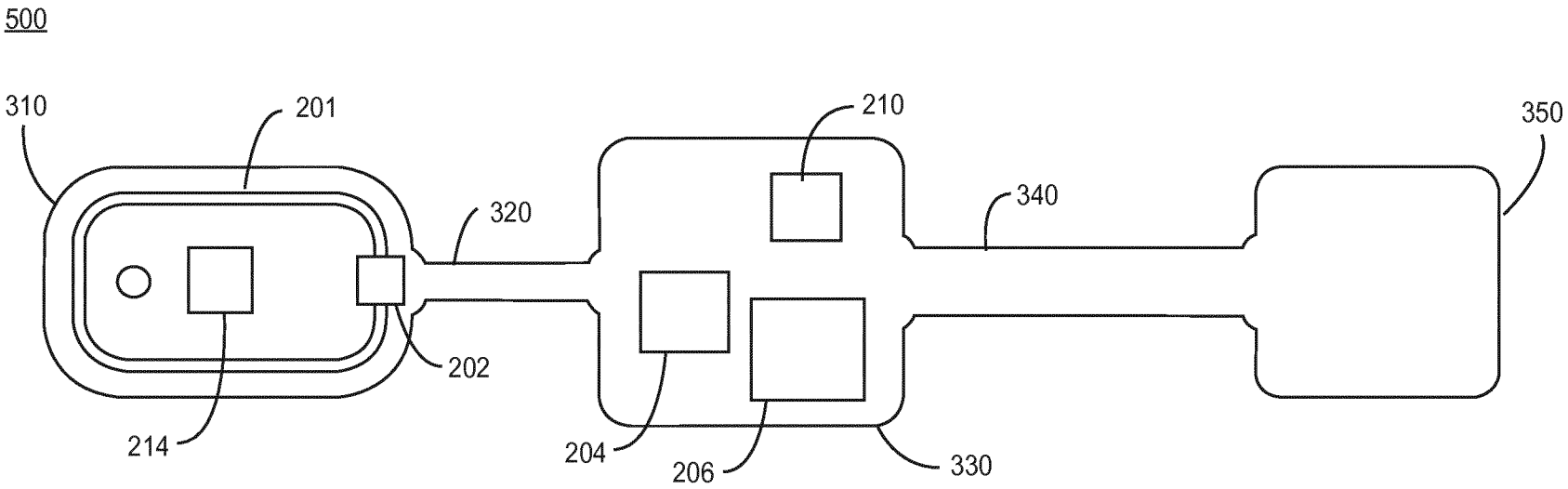
FIG. 5 is the bottom view of the PCBs as shown in FIG. 3.

A physical representation of the components and schematics shown in FIG. 2 is shown in FIG. 3. This physical representation is according to one embodiment and does not include the speaker 230 or microphone 240. A folded board construction is shown consisting of a first rigid antenna board 310, a first flexible PCB 320, a second rigid components board 330, a second flexible PCB 340, and a third rigid connector/safety board 350. In FIG. 3, a side view is shown. FIG. 4 shows a top view of the board construction of FIG. 3, where the rigid and flexible circuit boards are unfolded, or co-planar. FIG. 5 shows the bottom surfaces of the boards as they are unfolded. Because the designation "top" and "bottom" are reversed, and hence become confusing, when the boards 310 and 330 are folded over as shown in FIG. 3, the sides of the boards 310, 330, 350 are referred to herein as "first" and "second" sides. FIG. 5 depicts the first sides of all boards, and FIG. 4 depicts the second sides. The first and second side designations persist regardless of the orientation of any board 310, 330, 350.

Antenna board 310 is on the product side most protruding from the ear. This part will include the antenna 201 and the UI function 214, for easy user access. The antenna 201 is formed by a metal pattern in one of the layers on or near the first surface of board 310. For the antenna efficacy, it is important that other conductive elements are at least a minimum distance away (including the human body, the presence of which causes attenuation of the antenna gain). Therefore, there is a minimum air gap 305 between the antenna board 310 and components board 330. Also, the UI function 214, also on the first surface of board 310, is spaced apart from the antenna 201, as best seen in FIG. 5. Matching circuitry 202 is also placed on the first surface of the antenna board 310 such that the signals can be transferred from the antenna board 310 to the components board 330 via a 50-ohm transmission line formed by flexible PCB 320.

Radio transceiver 204, microcontroller 206, and PMU 210 are placed on the first side of the components board 330 to maximize the spacing away from antenna 201 when the boards are folded as depicted in FIG. 3. Radio transceiver 204, microcontroller 206, and PMU 210 may emit spurious signals due to clock edges and other noise that may interfere with the RF signals picked up by antenna 201. For further isolation, one of the layers in board 330 (and/or board 310) serves as a ground plane, thus preventing any emissions from the components on the first surface of board 330 from reaching the antenna 201. Front-end circuitry 203 and audio codec 208 are less harmful to the antenna 201 and can therefore be placed on the second side of the components board 330, where they will face the antenna board 310 when folded. Battery 212 is placed in between component board 330 and connector/safety board 350, and a flex PCB 340 is folded around the battery 212 to connect boards 330 and 350. The connector/safety board 350 contains the connector 250 and the battery safety circuitry 213. Connector/safety board 350 may include a contact to connect one polarity side of battery 212. Components board 330 may include a contact to connect the opposite polarity side of battery 212. Alternatively, the battery 212 maybe clipped onto the connector/safety board 350 with both battery polarity sides connected to connector/safety board 350. Antenna board 310 may contain a hole as visualized in FIG. 4 and FIG. 5, which may fit a microphone as will be discussed later.

Figure 6:
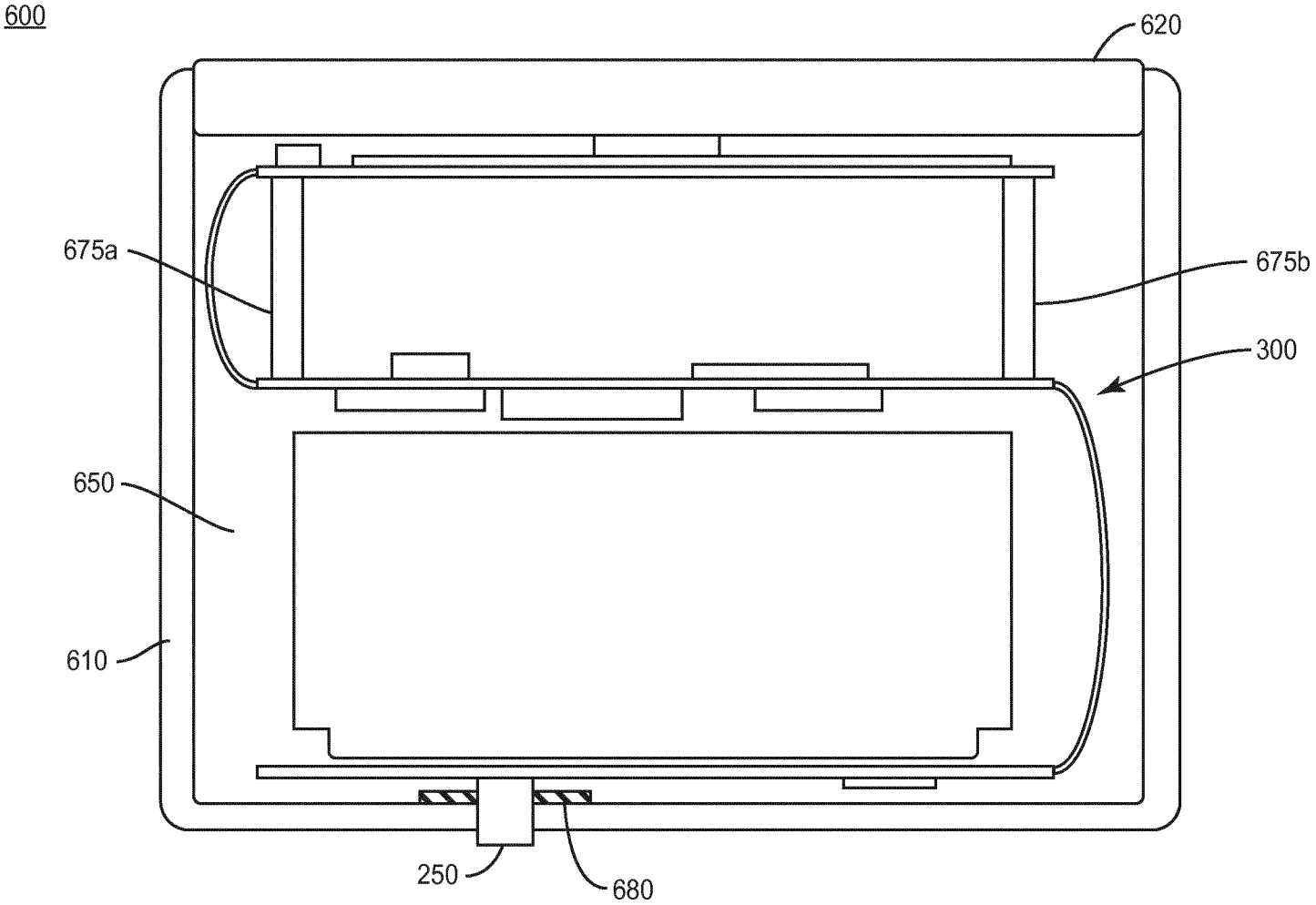
FIG. 6 is a first example of the folded electronics construction of FIG. 3 in a sealed enclosure.

The folded board construction, with battery 212 and all electronics components depicted in FIG. 3, is subsequently placed in a contained enclosure 600 as is shown in FIG. 6. In this embodiment, the speaker 230 and microphone 240 are not present and must be added later. The contained enclosure consists of a (non-conductive, e.g., plastic) enclosure 610. The cavity 650 inside this enclosure 610 will fit the folded construction 300 of FIG. 3. Inside the enclosure, there may be additional supports, either forming an integral part of the enclosure or separate (plastic) mechanical components, which give support to the folded construction 300 of FIG. 3, prevent the various parts of the folded construction 300 from moving, and maintain a determined distance between the various parts. As an example, pillars 675*a* and 675*b* are shown keeping boards 310 and 330 at a fixed distance. The enclosure is hermetically sealed with a lid 620. As a result, the cavity 650 will remain free of environmental substances like water, sweat, dust, and so on. The interface between the interior and the exterior is formed by the connector 250. This is the only hole required in enclosure 610. Care must be taken that the cavity 650 remains hermetically closed despite this hole. This will be accomplished by proper (hydrophobic) gluing material or other sealing means 680. Cavity 650 allows for sufficient space for the battery 212 to swell in case of malfunctioning, such that all safety specifications of the battery 212 are satisfied.

Figure 7:
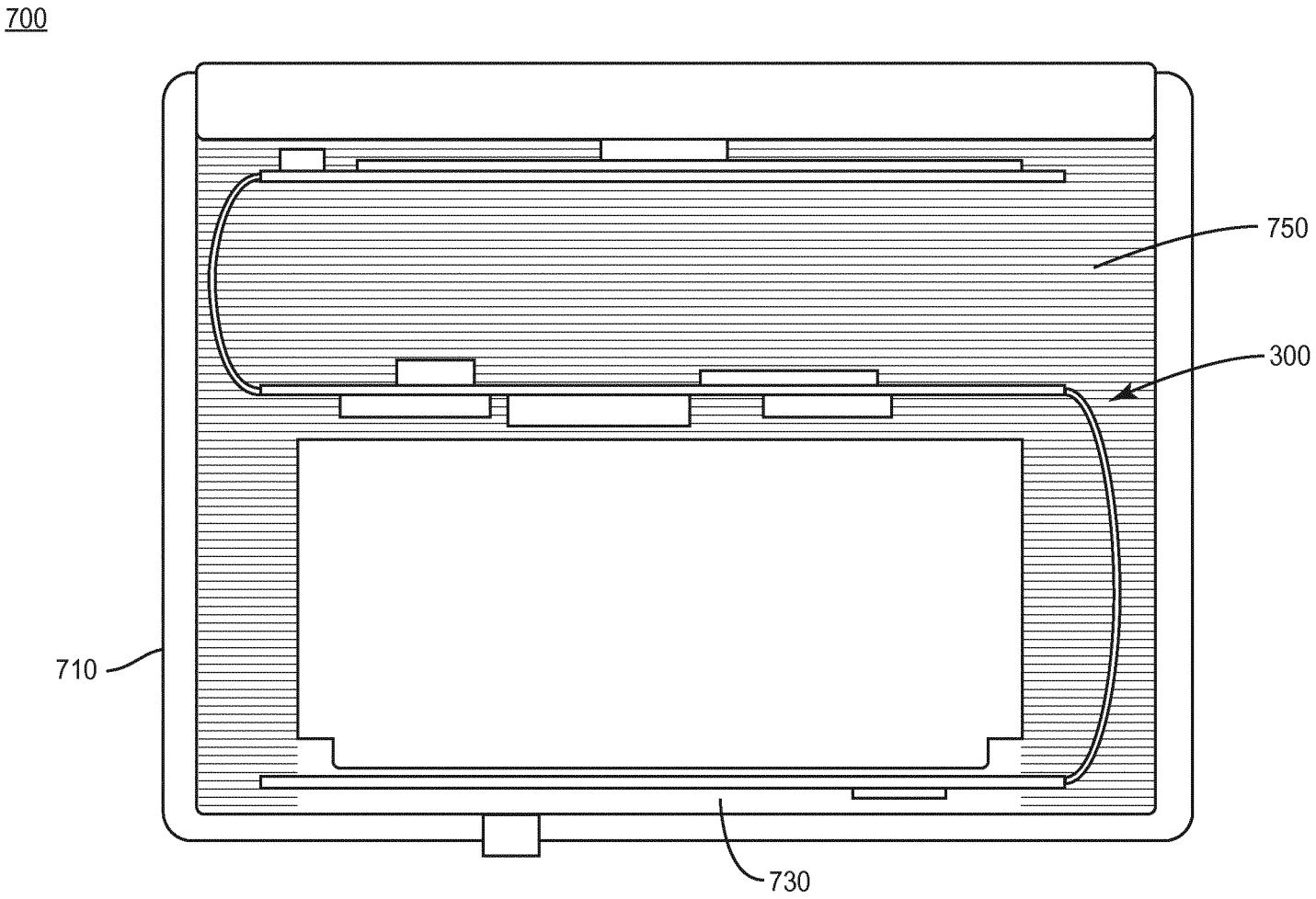
FIG. 7 is a second example of the folded electronics construction of FIG. 3 with embedding material in a sealed enclosure.

In FIG. 7, an alternative embodiment is shown, making use of 3D printing, molding, or similar techniques that can directly create a (sealed) enclosure around a physical object. The lid 620 is no longer present. The folded construction 300 (possibly with some support plastic components to keep the folded construction 300 in position), is placed in a 3D printing machine and the enclosure 710 is built around it, including the top cover. The insides 750 of the contained enclosure 700 may include cavities, supports, or other mechanical constructions to obtain a sturdy and reproducible sub-assembly. Additional air spaces, for example the air space 730 below the battery, are included to allow for the battery to swell in case of malfunctioning.

Figure 8:
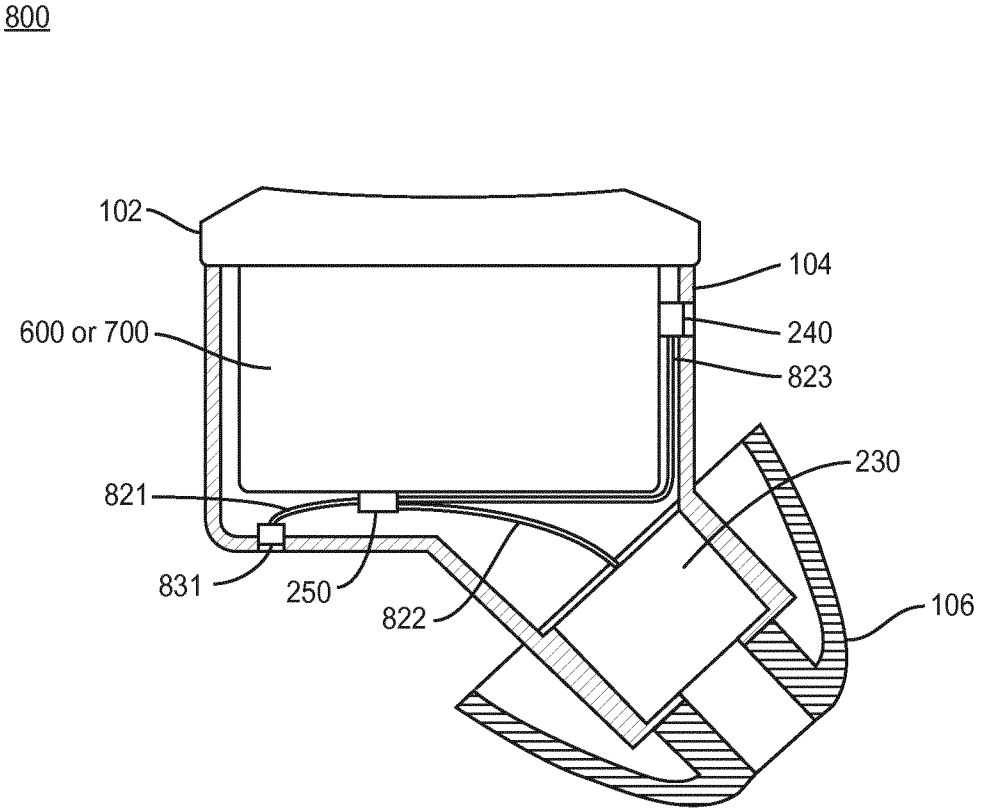
FIG. 8 is an example of a complete wireless audio product using the sub-assembly of FIG. 6 or FIG. 7.

Enclosure 610 with lid 620, or complete enclosure 710, with the folded construction 300 inside forms a sub-assembly 600, 700 around which a wireless audio product can be made. An example of such a wireless audio product 800 is shown in FIG. 8. This sub-assembly can be placed in housing 104 that has a proper visual design, place for a speaker 230 and microphone 240, and allows the use of an ear tip 106 for optimal fit and comfort. A cap 102 closes the housing 104 and can further enhance the branding appearance by use of brand logos, etcetera. Housing 104 does not have to be hermetically sealed, but at least serves as a first barrier towards the sensitive electronics inside the sub-assembly 600, 700. Connector 250 connects the internal components inside sub-assembly 600, 700 to external components, like the speaker 230 via connection 822 (which may be a flex conductor), the microphone 240 via connection 823, and the charging contact 831 via connection 821.

Figure 9:
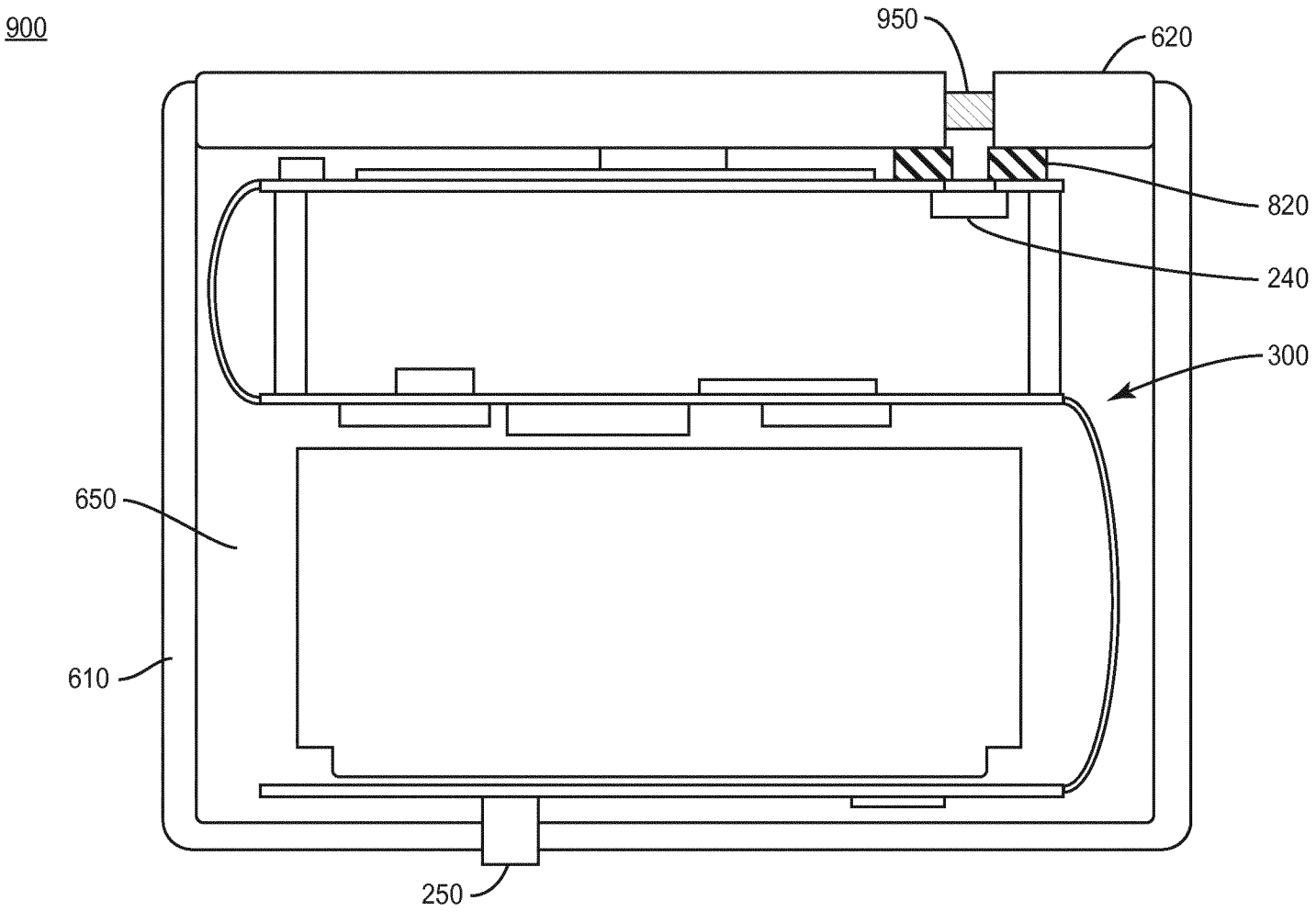
FIG. 9 is a third example of the folded electronics construction of FIG. 3 in a sealed enclosure including a microphone in a first location.

In the embodiment shown in FIG. 8, the microphone 240 is not part of sub-assembly 600, 700. The microphone signals reach the electronics (audio codec 208) via the connector 250. Another embodiment includes one or more microphones 240 in the sub-assembly. An example is shown in FIG. 9, corresponding to sub-assembly 600. Microphone 240 is placed on the antenna board 310. A hole is made in lid 620 for the air waves to reach the microphone 240. This hole is aligned with the hole on antenna board 310 as was shown in FIGS. 4 and 5. Sealing means 820 is applied to prevent environmental substances from entering the interior of the sub-assembly. Damper 950 is placed in the hole to control the air flow to the microphone and to keep dirt and grease from reaching the microphone 240.

Figure 10:
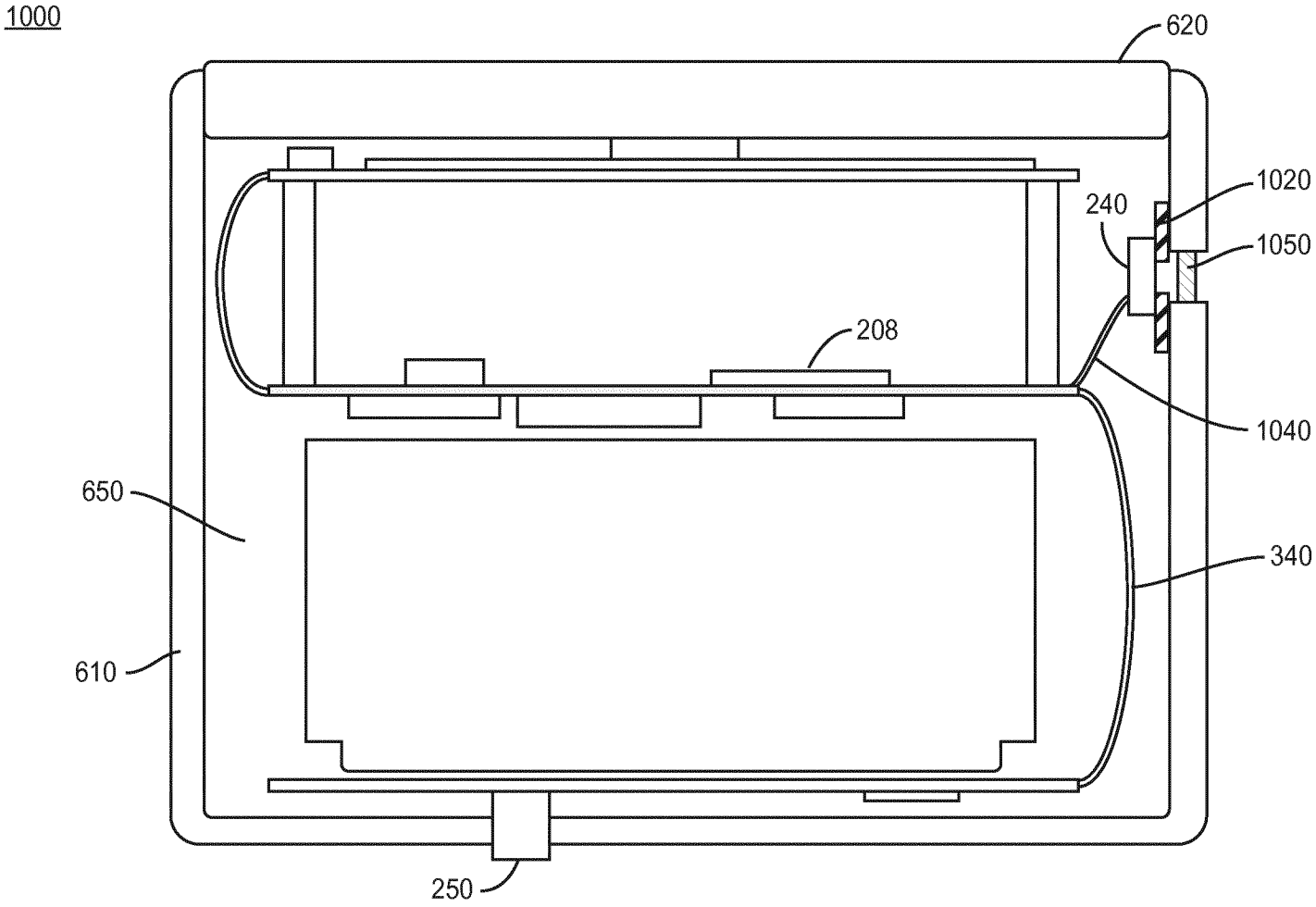
FIG. 10 is a fourth example of the folded electronics construction of FIG. 3 in a sealed enclosure including a microphone in a second location.

It will be readily apparent to one of ordinary skill in the art that a microphone can also be included in the sub-assembly 700. In this case (not shown), a hole is formed in enclosure 710 and proper sealing must be applied to keep the enclosure hermetically sealed. In another embodiment, the microphone is not placed on a board, but is connected via a wire, preferably using a flex PCB, to the board. This allows more flexibility of placement of the microphone, for example at the side of the sub-assembly, see FIG. 10. Microphone 240 is placed against enclosure 610, using sealing means 1020 to keep the enclosure hermetically closed. Damper 1050 is applied to control the air flow to the microphone and to keep dirt and grease from reaching the microphone 240. The microphone 240 is connected via a flex PBC 1040 to components board 330 where the audio codec 208 resides. In another example, the microphone is moved to a lower position in the sub-assembly 700 and could be placed on flex PCB 340. In that case, no separate flex PCB 1040 is needed.

When the sub-assembly 600 is embedded in the final product, the external housing must have the proper holes for the air waves to reach the microphone. For example, the embodiment shown in FIG. 10 could be placed in the housing 104 shown in FIG. 8 where the hole in the housing 104 matches with the hole in the enclosure 610 in sub-assembly 1000.

Figure 11:
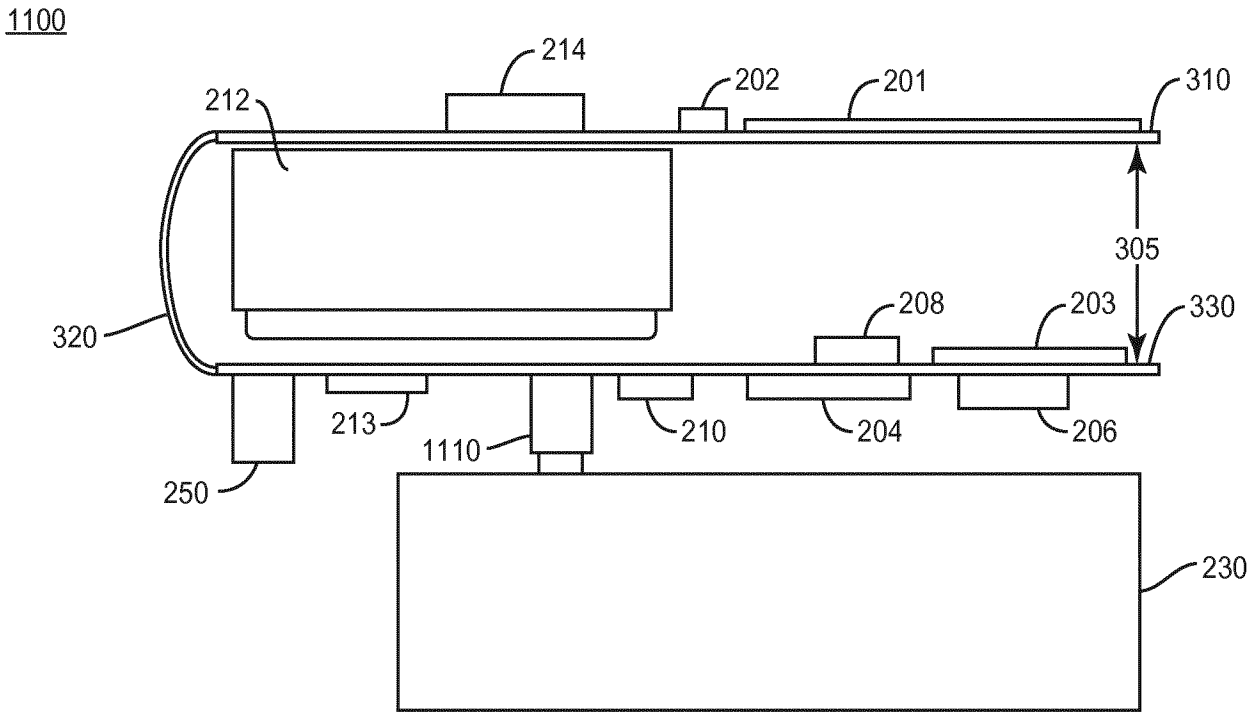
FIG. 11 is a side view of a folded electronics construction implementing the electronics of FIG. 2 and including a speaker.

In another embodiment of the sub-assembly, the speaker 230 is integrated as well. This especially relevant for so-called "open speaker" constructions where the speaker is not pushed into the ear canal of the user. These open speakers usually have a larger diameter. The side view of a folded construction, according to one embodiment, to fit the electronic components is shown in FIG. 11. Basically, the same electronic components as used in FIG. 3 are present, although they may have different positions on the boards 310, 330. Like reference numerals correspond to like structural elements. The connector/safety board 350 is omitted. Instead, connector 250 and safety circuit 213 are placed on the component board 330. Furthermore, the battery 212 is moved to reside between the antenna board 310 and component board 330. To minimize the interaction between the antenna 201 and the battery 211, antenna 201 is moved to the side and does not use the entire length of antenna board 310. The air gap 305 is maintained to keep sufficient distance to the ground planes in board 330. Loud speaker 230 is connected via connector 1110 to the component board 330. In one embodiment, connector 1110 is a flex PCB soldered to both the component board 330 and the speaker 230. In another embodiment, connector 1110 is an internal (female or male) connector soldered on component board 330. On the speaker 230, a corresponding (male or female) connector is soldered. When assembled, the speaker connector part is pushed into the board connector part to make a physical and electrical connection between speaker 230 and component board 330.

Figure 12:
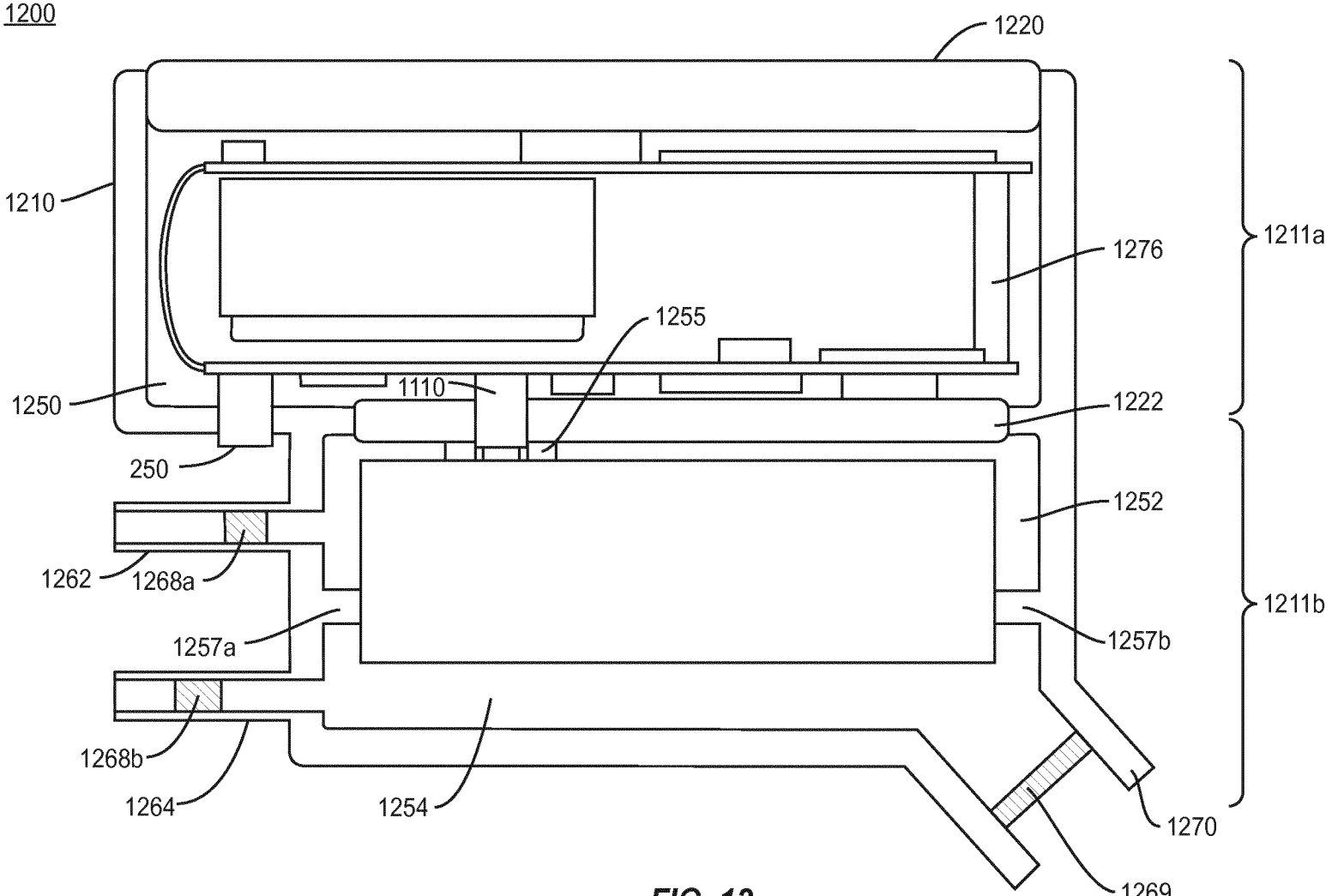
FIG. 12 is a first example of the folded electronics construction of FIG. 11 in a sealed enclosure.

The folded board construction with battery 212, speaker 230, and all electronic components depicted in FIG. 11 is subsequently placed in a contained enclosure 1200 as is shown in FIG. 12. In this embodiment, the microphone 240 is not present yet and must be added later. The contained enclosure consists of a (non-conductive, e.g., plastic) enclosure 1210. Enclosure 1210 consists of an upper part 1211*a* with a single cavity 1250, and a bottom part 1211*b* with cavity 1252 and cavity 1254. The cavity 1250 will fit the folded construction including the boards 310 and 330 with all electronic components and the battery 212 shown in FIG. 11. Inside the enclosure 1210, there may be additional (plastic) supports, either forming an integral part of the enclosure or separate (plastic) mechanical components, which give support to the folded construction, prevent the various parts from moving, and keep a determined distance between the various parts. As an example, pillar 1276 is shown keeping boards 310 and 330 at a fixed distance. Upper enclosure part 1211*a* is hermetically sealed with a lid 1220. As a result, cavity 1250 will remain free of environmental substances like water, sweat, dust, and so on. The interface between the interior and the exterior is formed by the connector 250. This is the only hole required in upper enclosure part 1211*a*. Care must be taken that the cavity 1250 remains hermetically closed despite this hole. This will be accomplished by proper (hydrophobic) gluing material or other sealing means. Cavity 1250 allows for sufficient space for the battery 212 to swell in case of malfunctioning, such that all safety specifications of the battery 212 are satisfied.

The bottom enclosure part 1211*b* consists of two cavities 1252 and 1254 which form the back and front acoustic chambers, respectively. Speaker 230 is placed in the bottom enclosure part 1211*b* such that there is no air flow from chamber 1252 to chamber 1254 and vice versa, i.e., they are acoustically separated by (plastic) sealings 1257*a* and 1257*b*. The speaker is placed in the bottom enclosure part 1211*b* from above before folded construction boards 310/330 are placed in cavity 1250 and before lid 1220 is placed. After speaker 230 is placed in position, lid 1222 is closed to acoustically separate the cavity 1250 from the cavity 1252. A hole in lid 1222 is needed to fit connector 1110 connecting the speaker 230 to the component board 330. Additional (plastic) sealing 1255 may be added to prevent any air leakage between cavity 1250 and cavity 1252.

To control the air flow in the back acoustic chamber 1252, a vent 1262 is present whose air flow can be regulated with damper 1268*a*. Damper 1268*a* has a certain air permeability that more or less hinders air from flowing inside and outside the back acoustic chamber 1252. Furthermore, the position of the damper 1268*a* determines the effective acoustic size of the back acoustic chamber 1252. In the same manner, to control the air flow in the front acoustic chamber 1254, a vent 1264 is present whose air flow can be regulated with damper 1268*b*. Damper 1268*b* has a certain air permeability that more or less hinders air from flowing inside and outside the front acoustic chamber 1254. Furthermore, the position of the damper 1268*b* determines the effective acoustic size of the front acoustic chamber 1252. Finally, nozzle 1270 is the acoustic load and guides the air flow to the user's ear.

Speaker 230, front and back acoustic chambers 1254 and 1252, vents 1264 and 1262, dampers 1268*b* and *a*, and nozzle 1270 together form an acoustic system. The frequency response of this acoustic system can be determined by the size of the acoustic cavities, the diameter of the nozzle, the diameter of the vents, and by the amount of air that can flow in and out of the vents per unit time. The latter depends on the diameter of the vents, the choice of material (air permeability characteristics) of the dampers, and the position of the dampers inside the vents. To a certain extent, acoustic fine tuning can be obtained by the positioning of dampers inside the vents as this will change the acoustic size of the chambers. The nozzle 1270 may include a protection means 1269 to prevent dust and grease from entering the front acoustic chamber 1254. This protection means should dampen the air flow into the user's ear as little as possible. Yet, it may have some influence on the final frequency response of the acoustic system.

Figure 13:
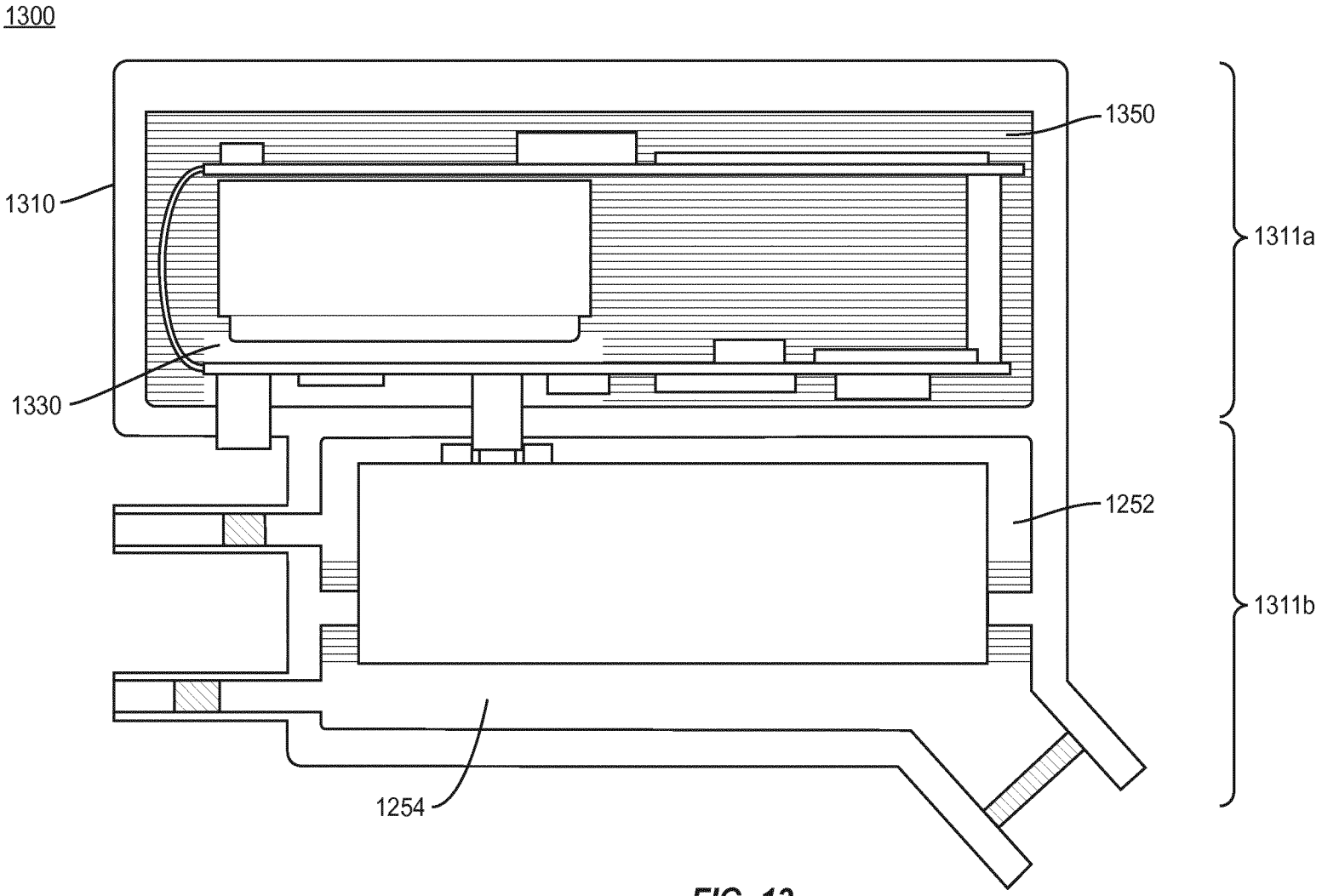
FIG. 13 is a second example of the folded electronics construction of FIG. 11 with embedding material in a sealed enclosure.

In FIG. 13, an alternative embodiment is shown, making use of 3D printing, molding or similar techniques that can directly create a (sealed) enclosure around a physical object. Lids 1220 and 1222 are no longer present. The folded construction 1100 (possibly with some support plastic components to keep the folded construction in position), is placed in a 3D printing machine and the enclosure 1310 is built around it, including the top cover. The interior 1350 of the contained enclosure 1300 may include cavities, supports, or other mechanical constructions to obtain a sturdy and reproducible sub-assembly. Additional air spaces, for example the air space 1330 below the battery 212, are included to allow for the battery 212 to swell in case of malfunctioning. Air spaces in the bottom enclosure part 1311*b* creating the back acoustic chamber 1252 and the front acoustic chamber 1254 are also preserved during the 3D printing process.

Figure 14:
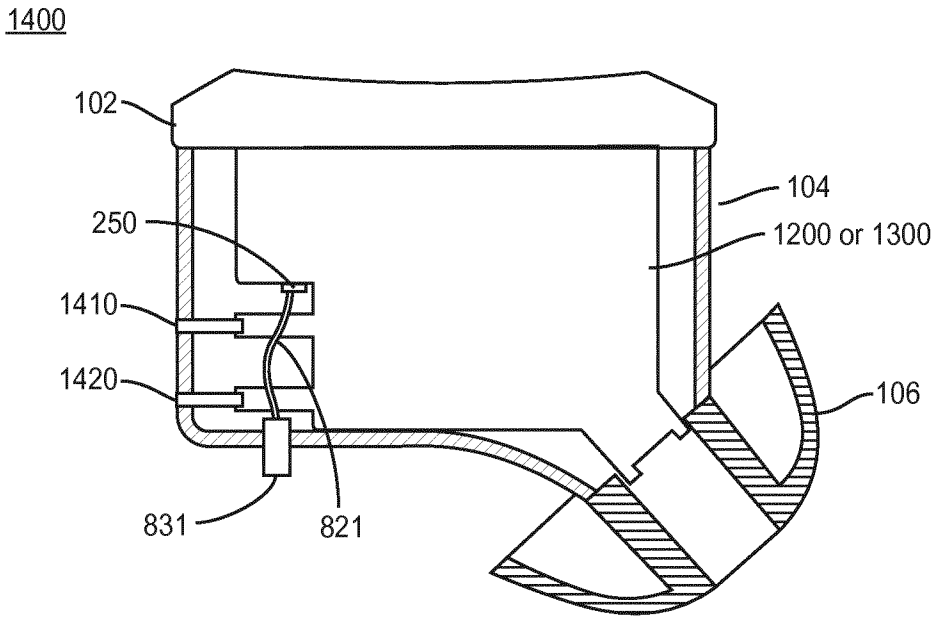
FIG. 14 is an example of a complete wireless audio product using the sub-assembly of FIG. 12 or FIG. 13.

Sub-assemblies 1200 and 1300 can readily be embedded in a wireless audio product. An example of such a wireless audio product is shown in FIG. 14. The sub-assembly is placed in housing 104 that has a proper visual design and allows the use of an ear tip 106 for optimal fit and comfort. A cap 102 closes the housing 104 and can further enhance the branding appearance by use of brand logos, etcetera. Housing 104 does not have to be hermetically sealed, but at least serves as a first barrier towards the sensitive electronics inside the sub-assembly 1200 (1300). Connector 250 connects the internal components inside sub-assembly 1200 (1300) to charging contact 831 via connection 821. Proper positioned holes 1410, 1420 in the housing 104 are needed to match the back vent 1262 and front vent 1264. Ear tip 106 should fit around nozzle 1270

Figure 15:
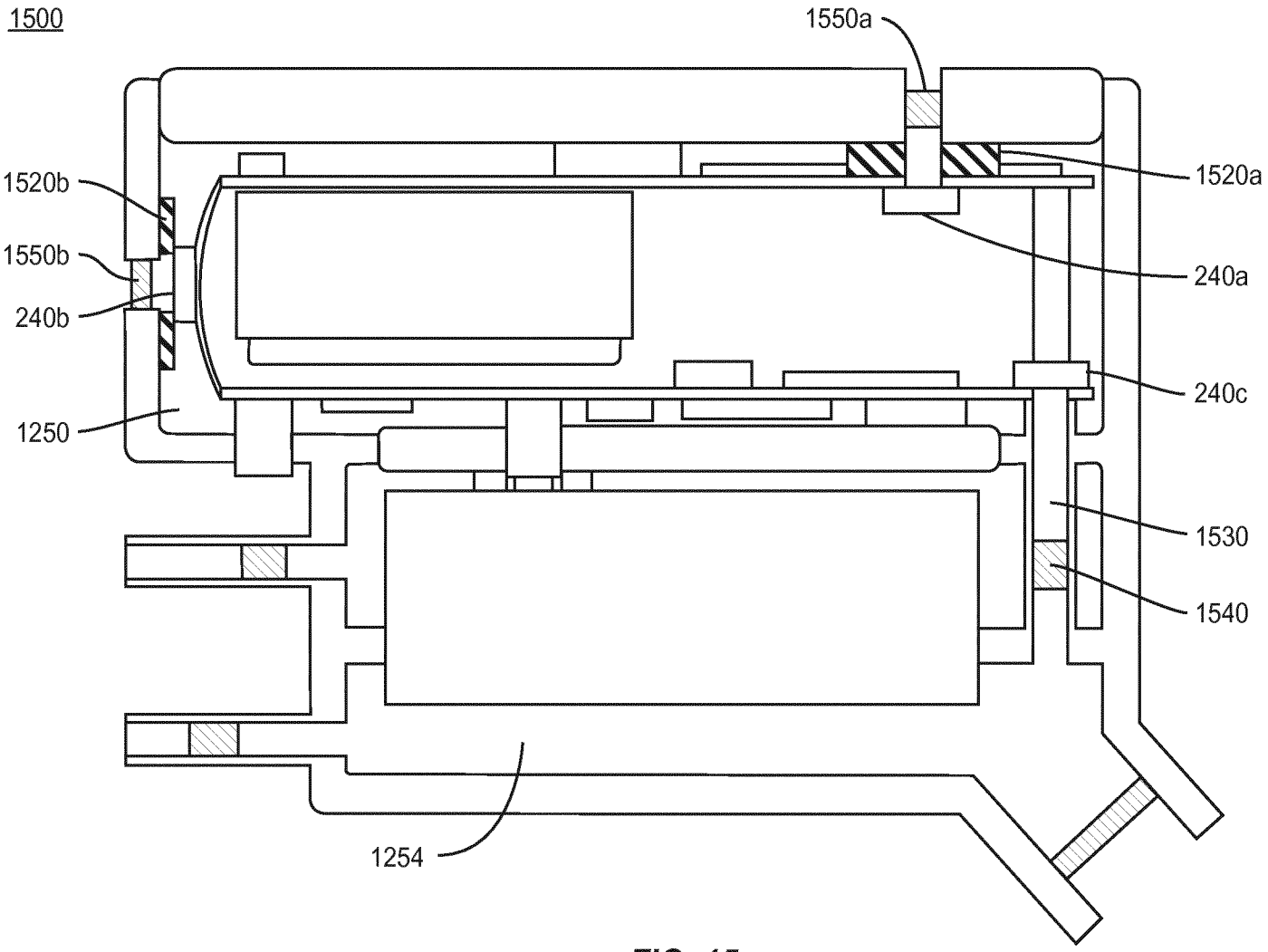
FIG. 15 is a third example of the folded electronics construction of FIG. 11 in a sealed enclosure with a microphone.

In FIGS. 12-14, no microphones are shown. The microphone can be part of the sub-assembly 1200 or 1300, like it was of the sub-assemblies 900 and 1000, or it can be external to the sub-assembly and be placed in the housing 104 of the final product as was shown in FIG. 8. In the latter case, the microphone must be wired to the connector 250 to reach the audio codec. In any case, proper holes in the housing 104 are required to feed the air waves to the microphone(s). In FIG. 15, the embodiment shown in FIG. 12 is extended with microphones. Microphone 240*a* mounted on antenna board 310 and microphone 240*b* mounted on flexible PCB 320 are added to pick up the voice. Multiple MICs are arranged to be able to separate the desired voice from the background noise. Sealing means 1520*a* and 1520*b* are applied to keep the cavity 1250 hermetically closed. Dampers 1550*a* and 1550*b* are applied to control the air flow to the microphones and to keep dirt and grease from reaching the microphones.

Microphone 240*c* can be added to measure the pressure in the front acoustic chamber 1254. An internal acoustic passage, such as tube 1530, connects the bottom acoustic chamber 1254 to the microphone 240*c*. Optionally, damper means 1540 may be added to control the air flow to the microphone 240*c*. Microphone 240*c* can be used for acoustic tuning, but can also be used for active noise cancelling techniques. The sound measured in the front chamber by microphone 240*c* is converted into an electrical signal and fed back to the audio codec, where it is compared to the original audio signal (e.g., music). Any differences are electronically minimized and compensated for.

To the sub-assemblies described above, several sensors may be added. Sensor can be added user interface (UI), e.g., to control functions like volume up/volume down, next track, start/stop, on/off. Other sensing functions may be in-ear detection, detecting ambient conditions, and human body functions like heart rate, oxygen saturation, temperature, etc.

In FIG. 8 and FIG. 14, charging contact 831 in the external housing 104 is present for a galvanic connection (via connector 250) between an external charging cradle (not shown) and the PMU 210. However, instead of a galvanic connection, a wireless connection is used in one embodiment, resulting in wireless charging. Magnetic induction can be applied to transfer energy from the cradle to the battery 212. For magnetic induction, a transmit coil in the cradle is placed in close proximity (and properly aligned) to a receiving coil present in the product 800 or 1400. The receiving coil may be on the inside of housing 104 replacing contact 831. Alternatively, the receiving coil may be inside the sub-assembly 600/700 or 1200/1300.

Figure 16:
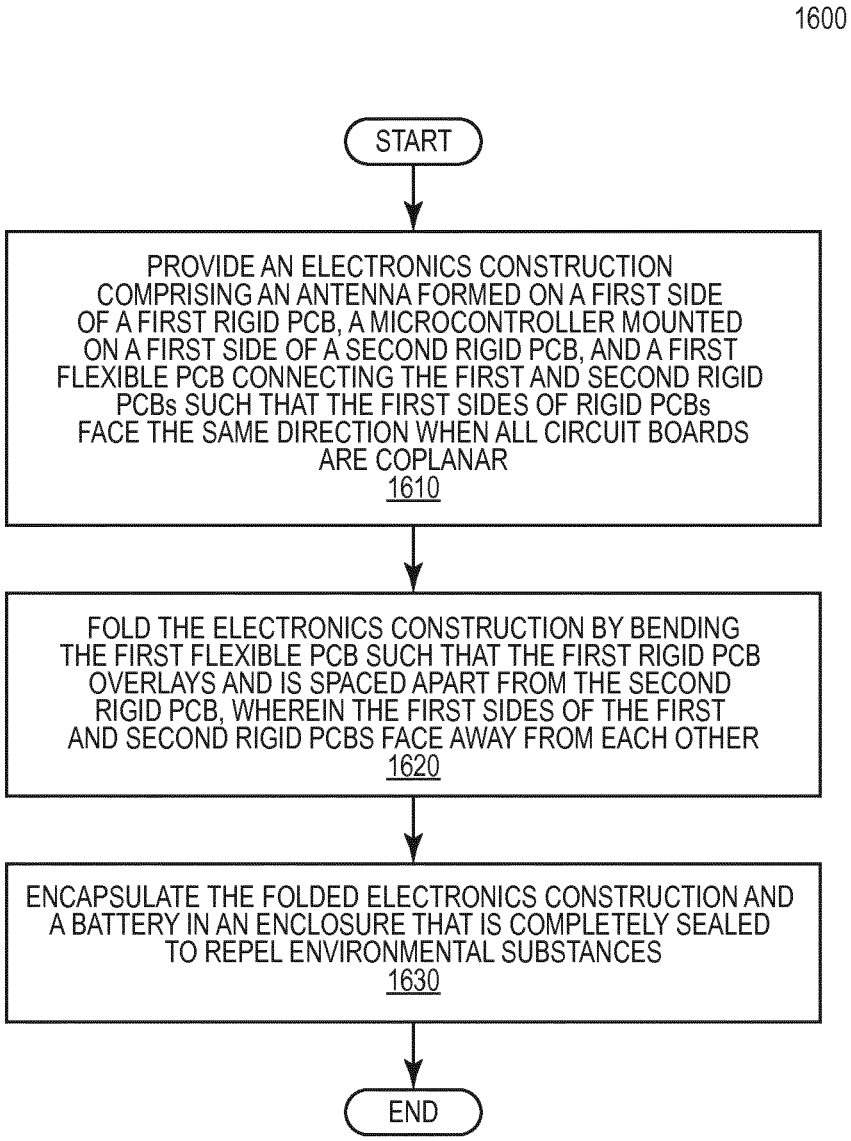
FIG. 16 is a flow diagram of a method of manufacturing an audio headset sub-assembly.

FIG. 16 depicts the steps in a method 1600 of manufacturing an audio headset sub-assembly, according to embodiments of the present invention. An electronics construction 300 is provided (block 1610). The electronics construction 300 comprises an antenna 201 formed on a first side of a first rigid PCB 310, a microcontroller 206 mounted on a first side of a second rigid PCB 330, and a first flexible PCB 320 connecting the first 310 and second 330 rigid PCBs such that the first sides of rigid PCBs 310, 330 face the same direction when all circuit boards 310, 320, 330 are coplanar. The electronics construction 300 is folded by bending the first flexible PCB 320 such that the first rigid PCB 310 overlays and is spaced apart from the second rigid PCB 330, wherein the first sides of the first 310 and second 330 rigid PCBs face away from each other (block 1620). The folded electronics construction 300 and a battery 212 are encapsulated in an enclosure 610, 710, 1210, 1310 that is completely sealed to repel environmental substances (block 1630). The encapsulation step 1630 may comprise placing the folded electronics construction 300 and battery 212 in a molded enclosure body, and sealing the body with a lid 620, 1220. Alternatively, the encapsulation step 1630 may comprise building the enclosure 610, 710, 1210, 1310 around the folded electronics construction 300 and the battery 212 using a 3D printing or molding process.

Embodiments of the present invention present numerous advantages over the prior art. The embodiments provide a fully functional, self-contained audio system that is easily designed into a variety of "true wireless" headphones. Embodiments without a microphone are optimized to music playback applications; embodiments with an integrated microphone(s) are appropriate for telephone or radio headsets. The designs are compact, featuring a novel combination of hard and flexible PBC boards that are "foldable" to optimize volumetric size and placement. Component configurations are optimized to minimize interference between processing circuitry and RF circuits. The modules are hermetically sealed for durability and long life, and comply with safety regulation such as malfunctioning battery expansion. Some embodiments with integrated speakers feature advanced audio tuning features and capabilities, such as separate and ported acoustic chambers, and an internal microphone for feedback applications such as noise cancellation.

The present invention may, of course, be constructed in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. An audio headset sub-assembly, comprising a battery and a folded electronics construction, comprising two or more rigid circuit boards connected by at least one flexible circuit board and folded around the battery, placed together in a contained enclosure separate from a housing that contains it, the folded electronics construction holding components implementing functionality including:

an antenna;

a radio transceiver;

a microcontroller;

an audio codec;

a power management unit; and a connector coupled to one of the circuit boards;

wherein the contained enclosure is characterized by:

a first cavity including the battery and circuit boards, the cavity being completely sealed to repel environmental substances;

air space to allow for the battery to swell in the event of malfunction; and a hole in the enclosure wherein the connector is sealed.

2. The sub-assembly of claim 1 further characterized by at least one microphone connected to the audio codec for voice pick-up.

3. The sub-assembly of claim 1 further characterized by a receive coil to support wireless charging.

4. The sub-assembly of claim 1 wherein the contained enclosure is built first in a molding process and the battery and folded board containing electronic components are inserted in the enclosure afterwards, after which the enclosure is sealed.

5. The sub-assembly of claim 1 wherein the contained enclosure is built around the battery and folded board containing electronic components using a 3D printing or molding process.

6. The sub-assembly of claim 1 wherein the contained enclosure is further characterized by:

a second cavity including a speaker, the second cavity comprising a first air space forming a back acoustic chamber at the back end of the speaker and a second air space forming a front acoustic chamber at the front end of the speaker and a venting hole in air flow relationship with the back acoustic chamber.

7. The sub-assembly of claim 6 further characterized by one or more venting holes in air flow relationship with the front acoustic chamber.

8. The sub-assembly of claim 6 further characterized by at least one noise cancellation microphone being operative to measure air pressure in the front acoustic chamber.

9. The sub-assembly of claim 8, further characterized by an acoustic passage connecting the noise cancellation microphone with the front acoustic chamber.

10. The sub-assembly of claim 8, wherein the signal of the noise cancellation microphone is used for active noise cancellation.

11. The sub-assembly of claim 6 wherein the first cavity is acoustically separated from the second cavity.

12. The sub-assembly of claim 1 wherein the folded electronics construction comprises:

the antenna formed on a first side of a first printed circuit board, PCB;

the microcontroller mounted on a first side of a second PCB;

a first flexible PCB connecting the first and second PCBs such that the first sides of PCBs face the same direction when all circuit boards are coplanar;

wherein the first flexible PCB is bent such that the first PCB overlays and is spaced apart from the second PCB, wherein the first sides of the first and second PCBs face away from each other.

13. The sub-assembly of claim 12 wherein at least one of the first and second PCBs includes a ground plane, and wherein the ground plane is interposed between the first side of the first PCB and the first side of the second PCB, and is operative to provide RF shielding between the antenna and the microcontroller.

14. The sub-assembly of claim 12 wherein the battery is disposed between the first and second PCBs.

15. The sub-assembly of claim 14 further characterized by a speaker connected to the first side of the second PCB.

16. The sub-assembly of claim 12 wherein the folded electronics construction further comprises:

a third PCB;

a second flexible PCB connecting the second and third PCBs such that the first sides of the PCBs face the same direction when all circuit boards are coplanar;

wherein the second flexible PCB is bent such that the third PCB underlays and is spaced apart from the second PCB, wherein the first sides of the second and third PCBs face towards each other; and the battery is disposed between the second and third PCBs.

17. The sub-assembly of claim 16 wherein the connector is mounted on a second side of the third PCB.

18. A method of manufacturing an audio headset sub-assembly characterized by:

providing an electronics construction comprising an antenna formed on a first side of a first rigid printed circuit board, PCB, a microcontroller mounted on a first side of a second PCB, and a first flexible PCB connecting the first and second PCBs such that the first sides of PCBs face the same direction when all circuit boards are coplanar;

folding the electronics construction by bending the first flexible PCB such that the first PCB overlays and is spaced apart from the second PCB, wherein the first sides of the first and second PCBs face away from each other; and encapsulating the folded electronics construction and a battery in a first cavity of a contained enclosure that is completely sealed to repel environmental substances and that is separate from a housing that contain the contained enclosure.

19. The method of claim 18 further comprising disposing the battery between the first and second PCBs prior to the encapsulating step.

20. The method of claim 18 further characterized by:

providing a speaker operatively connected to the electronics construction; and encapsulating the speaker in a second cavity comprising a first air space forming a back acoustic chamber at the back end of the speaker and a second air space forming a front acoustic chamber at the front end of the speaker; and wherein the back acoustic chamber includes a venting hole in air flow relationship with exterior of the enclosure.

21. The method of claim 18 wherein encapsulating the folded electronics construction and the battery in the first cavity of the contained enclosure comprises:

providing a body of the enclosure;

placing the folded electronics construction and the battery in the body of the enclosure; and sealing the body of the enclosure with a lid.

22. The method of claim 21 wherein providing a body of the contained enclosure comprises forming the enclosure in a molding process.

23. The method of claim 18 wherein encapsulating the folded electronics construction and the battery in the first cavity of the contained enclosure comprises building the contained enclosure around the folded electronics construction and the battery using a 3D printing or molding process.

24. The method of claim 23 further characterized by:

providing a microphone operatively connected to the electronics construction; and forming one or more air passages in the contained enclosure connecting the exterior of the enclosure in air flow relationship to the microphone.

25. The method of claim 23 further characterized by:

providing at least one noise cancellation microphone operatively connected to the electronics construction and operative to measure air pressure in the front acoustic chamber; and forming an acoustic passage connecting the noise cancellation microphone with the front acoustic chamber;

wherein the signal of the noise cancellation microphone is used for active noise cancellation.

* * * * *